US007494014B2

(12) United States Patent
Martinez

(10) Patent No.: US 7,494,014 B2
(45) Date of Patent: Feb. 24, 2009

(54) SHIPPING CONTAINER FOR SOLID HAZARDOUS MATERIAL

(75) Inventor: Carlos L. Martinez, Dalton, OH (US)

(73) Assignee: Questar, Inc., North Canton, OH (US)

( * ) Notice: Subject to any disclaimer, the term of this patent is extended or adjusted under 35 U.S.C. 154(b) by 97 days.

(21) Appl. No.: 11/789,341

(22) Filed: Apr. 24, 2007

(65) Prior Publication Data

US 2007/0251858 A1 Nov. 1, 2007

Related U.S. Application Data

(60) Provisional application No. 60/795,094, filed on Apr. 26, 2006.

(51) Int. Cl.
*B65D 85/88* (2006.01)

(52) U.S. Cl. ..... 206/705; 206/499; 206/524.3; 53/467; 220/495.06; 229/117.27

(58) Field of Classification Search ..... 206/703, 206/705, 723, 725, 499, 561, 524.3–524.5; 53/467, 468, 473–475; 220/495.01, 495.05, 220/495.06, 505, 507, 510, 528, 529; 229/117.27, 229/117.3; 429/9, 99, 100
See application file for complete search history.

(56) References Cited

U.S. PATENT DOCUMENTS

| | | | | |
|---|---|---|---|---|
| 3,516,596 | A * | 6/1970 | Madden et al. | 206/499 |
| 3,994,115 | A * | 11/1976 | Mako et al. | 206/499 |
| 4,826,012 | A * | 5/1989 | Kosanovich | 206/499 |
| 5,163,555 | A * | 11/1992 | West et al. | 229/117.27 |
| 5,670,268 | A | 9/1997 | Mancusi | |
| 5,992,634 | A * | 11/1999 | Woodring et al. | 206/524.3 |
| 6,227,370 | B1 | 5/2001 | Earnshaw et al. | |
| 6,478,158 | B2 | 11/2002 | Gaffney et al. | |

* cited by examiner

*Primary Examiner*—Luan K Bui
(74) *Attorney, Agent, or Firm*—Sand & Sebolt

(57) ABSTRACT

A container for shipping hazardous solid materials, such as dry cell batteries, has a rigid outer housing formed of a corrugated fiberboard material with an interior plastic liner. A plurality of different size dividers are placed in a vertical stacked relationship within the liner and storage chamber formed by the housing and are separated by flat planar partitions. The dividers form a plurality of individual storage compartments of various sizes for individually holding various size batteries for shipment. The dividers have various heights so that when combined with intervening partitions have a height generally equal to the height of the internal storage chamber.

19 Claims, 4 Drawing Sheets

SHIPPING CONTAINER FOR SOLID HAZARDOUS MATERIAL

CROSS REFERENCE TO RELATED APPLICATIONS

This application claims priority from U.S. Provisional Application Ser. No. 60/795,094 filed Apr. 26, 2006; the disclosure of which is incorporated herein by reference.

BACKGROUND OF THE INVENTION

1. Technical Field

The invention relates to shipping containers for hazardous solid materials, and in particular to a shipping container for shipping dry cell batteries. Even more particularly, the invention relates to a shipping container for batteries which provides for the safe storage and transportation of a plurality of different size batteries in the same container without the danger of the battery terminals coming into contact with each other.

2. Background Information

Dry cell batteries such as alkaline, ni-cad, lithium etc. are sold, used and disposed of by the thousands each day and are becoming a hazard when deposited in landfills or other disposal locations. Many retail outlets, as well as battery manufacturers, are providing used battery collection areas at certain retail stores requesting customers to return their used batteries for proper disposal. One problem that exists after collecting the used batteries is the shipment of the used batteries to a proper disposal location. Federal law requires that the batteries be shipped in a condition where the terminal of the batteries cannot come into contact with each other which could result in a spark and subsequent fire. Therefore, the batteries must be shipped in individual containers or have the terminals covered in some manner before shipment, all of which increases the difficulty and expense of properly shipping the batteries for disposal. Federal regulations, in particular 49 CFR 173.85 sets forth stringent requirements for the shipping of batteries, whether new or used.

BRIEF SUMMARY OF THE INVENTION

The present invention provides a shipping container for shipping solid hazardous material, and in particular for shipping a plurality of batteries of various sizes in a single container, which container is in compliance with Federal regulations as set forth in 49 CFR 173.85, wherein the terminals of the batteries are prevented from contacting each other. This is achieved by providing the container with a plurality of individual storage compartments, each of which is intended to contain a single battery.

A further aspect of the present invention is to provide such a shipping container which can safely store and ship various sized batteries, each in its own compartment within the same container, by providing a plurality of tiers, each containing a plurality of individual compartments, by use of a plurality of dividers stacked in a vertical relationship and separated by horizontal partitions.

Another aspect of the present invention is to provide the shipping container with a plastic liner, such as a polyethylene liner, which protects the stored batteries against exterior moisture as well as providing containment to any battery acid leakage, which liner is contained within an outer fiberboard housing, preferably formed of a double-walled corrugated fiberboard.

Still another aspect of the invention is to enable the compartment defining dividers to be mixed and matched when placed within an outer housing and plastic liner to accommodate the various sizes of batteries, which when assembled in a vertical stacked relationship fills the interior of the outer housing to ensure that the tiers remained in a secure, vertical stacked relationship.

Another aspect of the present invention is to provide the outer housing with closure flaps which are taped in an H-shaped pattern to ensure that the container remains sealed throughout its transportation to a final disposal site and comply with the requisite Federal regulations.

Another feature of the invention is to form the plastic liner of polyethylene having a preferred thickness of 3 mils and securing the plastic liner in a sealed, closed position with some type of fastener after the individual storage compartments of the dividers are filled with individual batteries.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
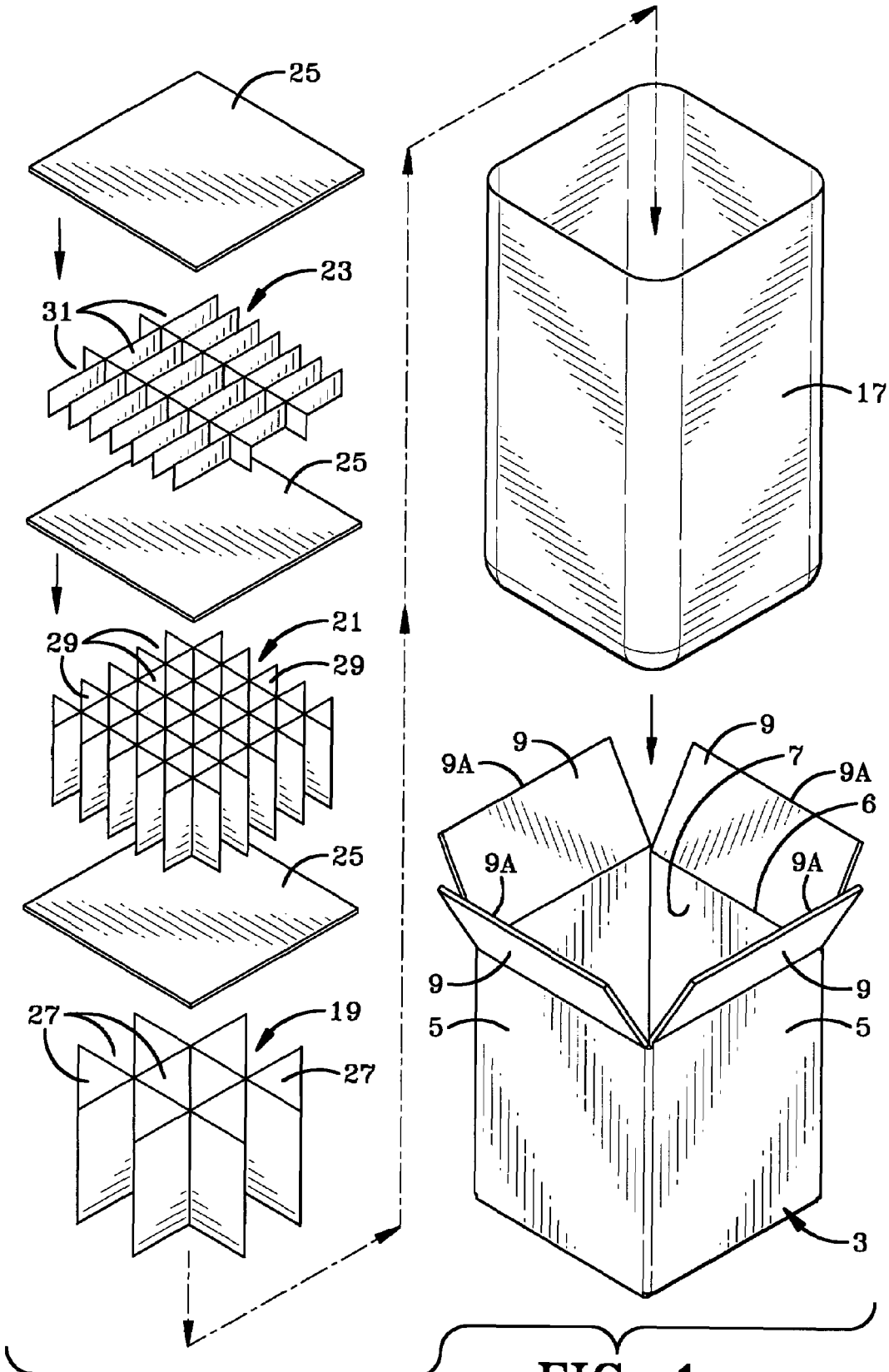
FIG. 1 is a diagrammatic exploded perspective view of the shipping container of the present invention.
Figure 2:
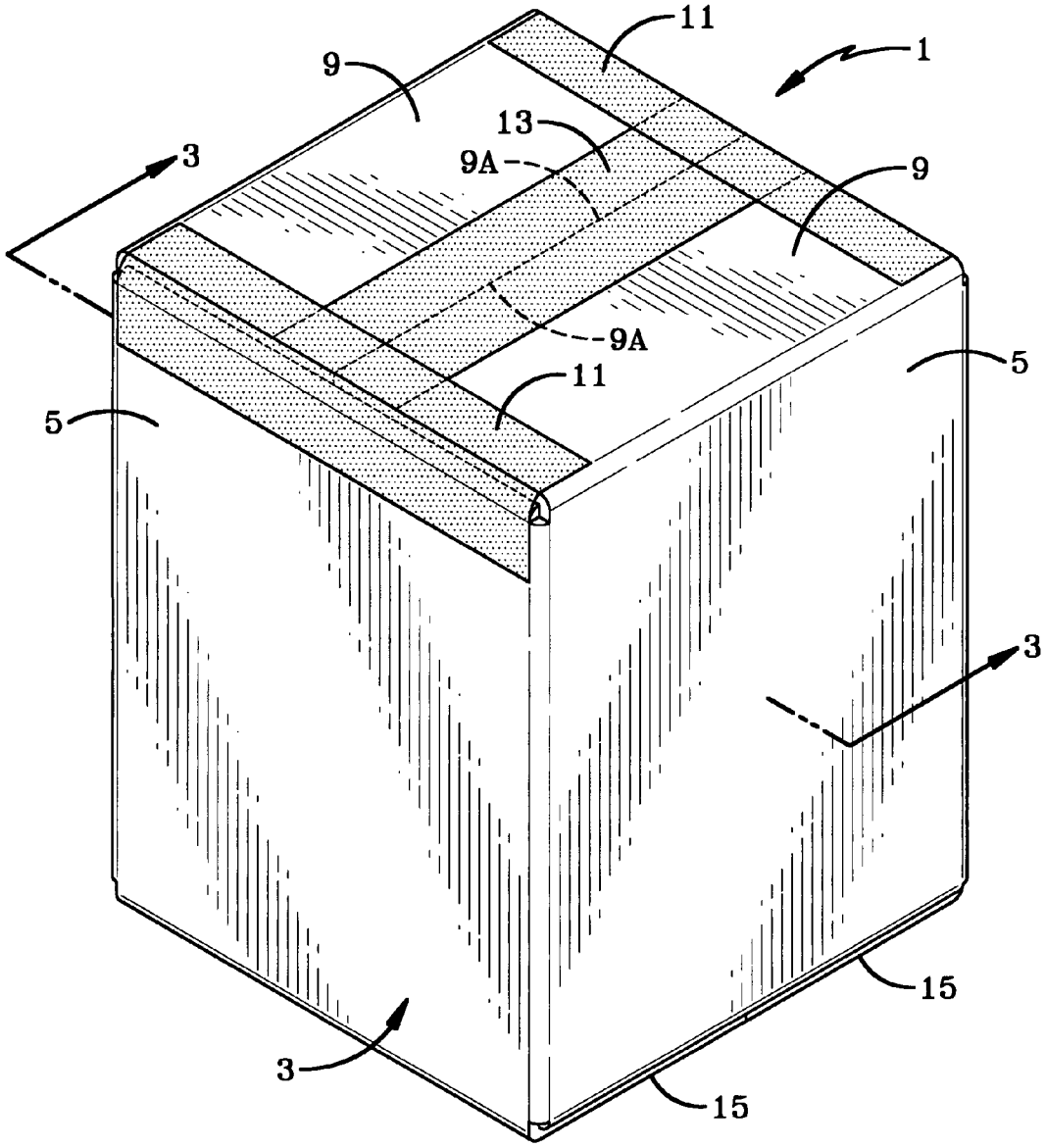
FIG. 2 is a perspective view of the shipping container in a closed sealed position.
Figure 3:
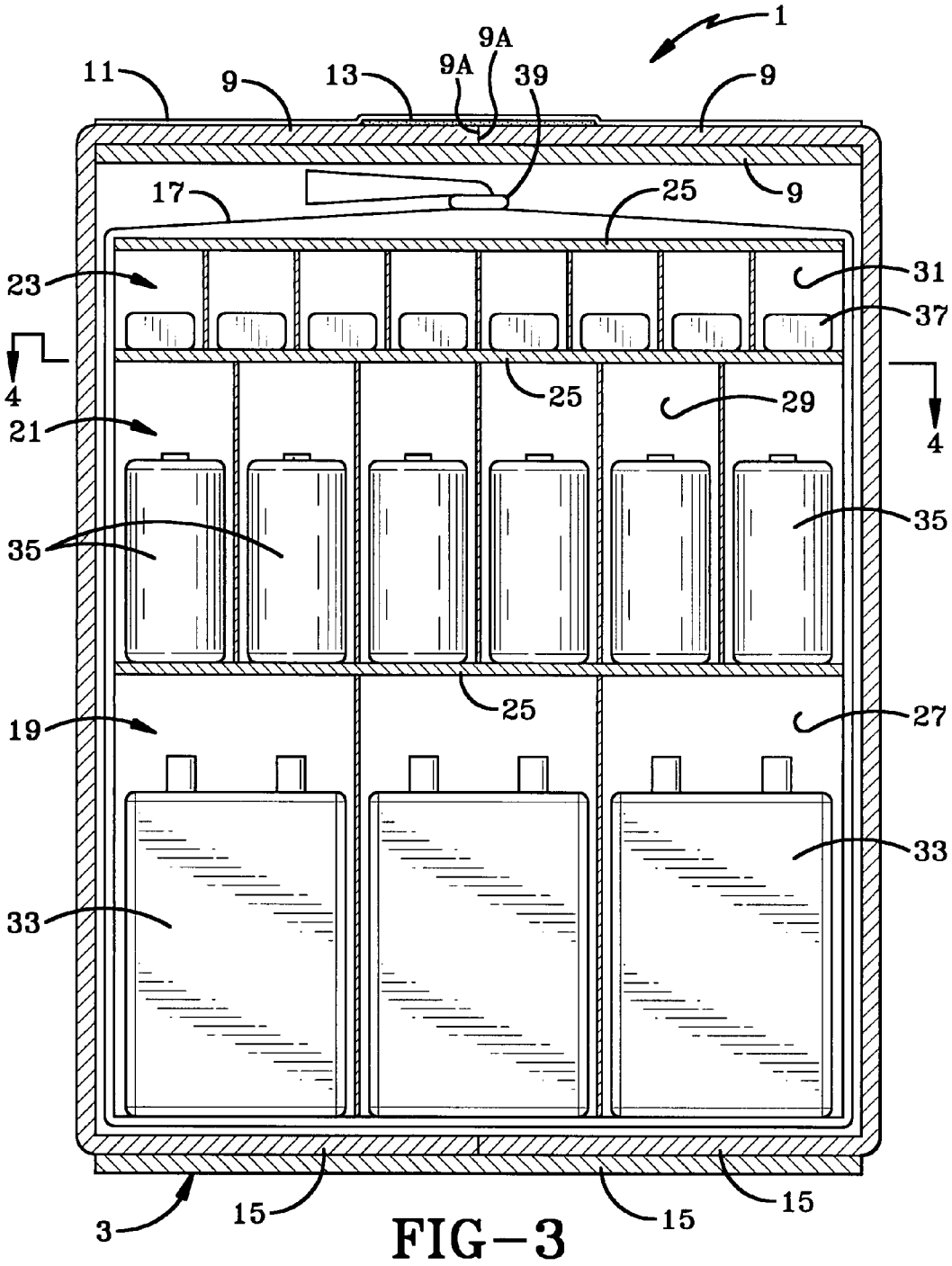
FIG. 3 is an enlarged sectional view taken on line 3-3, FIG. 2.

The improved shipping container of the present invention is indicated generally at 1, and is shown in a sealed closed position in FIG. 2, and in an exploded perspective condition in FIG. 1. Container 1 includes an outer housing indicated generally at 3, preferably having a parellelopiped configuration with four spaced parallel side walls 5 which provide an open top 6 and which define a hollow internal storage chamber 7. A plurality of closure flaps 9 preferably are formed integrally with the upper edges of side walls 5 and are adapted to be placed in an overlapping relationship when closing the open top 6 of outer housing 3 as shown in FIGS. 2 and 3. After the pairs of opposed flaps 9 are placed in the overlapping closed relationship with their outer edges 9A being in abutting relationship, the outer housing is sealed by an H-configured taping arrangement consisting of two strips 11 which extend along the junction of the two topmost pair of flaps 9 and their respective side walls 5 after a cross strip 13 extends over and secures the abutted edges of the top two closure flaps in a secure closed position for subsequent shipment (FIG. 2). The bottom of outer housing 3 preferably will be initially opened and secured with similar closure flaps 15 as shown in FIG. 3, and sealed in some manner such as with tape or adhesives. Outer housing 3 preferably is formed of a fiberboard material, preferably a double-walled corrugated fiberboard material, which provides sufficient strength and rigidity to container 1 and complies with the required Federal regulations for shipping hazardous materials such as batteries. In the preferred embodiment, walls 5 and flaps 9 will have a thickness of approximately ¼ inch although this thickness can vary within the concept of the present invention.

Referring to FIG. 1, a plastic liner 17 preferably formed of polyethylene with a thickness of approximately 3 mils, is placed within internal storage chamber 7 forming an interior liner which generally conforms to the shape and size of storage chamber 7.

In accordance with one of the features of the invention, a plurality of dividers indicated at 19, 21 and 23 are placed in a vertical stacked tiered relationship within plastic liner 17 and interior storage chamber 7 as shown in FIG. 3, and are separated by individual planar partitions 25. Partitions 25 preferably are formed of the same fiberboard or cardboard material as housing 3. Dividers 19, 21 and 23 may be of the type shown in U.S. Pat. No. 6,227,370 or have other constructions, and form a plurality of individual storage compartments 27, 29 and 31 respectively, within each of the dividers for receiving individual batteries 33, 35 and 37 therein as shown in FIGS. 1 and 3. The dividers which preferably are formed of an inexpensive cardboard material, have different heights and number of individual storage compartments to accommodated different size batteries as shown in FIG. 3. The individual compartments 27, 29 and 31 are sized to accommodate various size batteries commonly used in many electrical appliances and apparatus. For example, compartments 27 are sized to receive usual 9 volt electrical lantern-size batteries, with compartments 29 be sized to receive the usual D-sized batteries, with compartments 31 being sized to receive the smaller AA and AAA size batteries. However, the sizes of these individuals compartments can very without affecting the concept of the invention but have been found to accommodate the majority of the common-size batteries used for most electrical appliances and apparatus.

Each divider 19, 21 and 23 have open tops and bottoms which are closed by partition members 25 which serve as the support for the batteries located above as shown in FIG. 3. Preferably, a topmost partition 25 is placed on the open top of top divider 23 to prevent the batteries 37 stored therein from falling out of the compartments if the container is turned upside down.

As shown in FIG. 3, after the individual compartments of the dividers are filled with batteries and are separated by partitions 25, a top partition 25 preferably is placed on the top of divider 23 to close the open tops of the individual storage compartments. The top of plastic liner 17 is then closed and secured by a closure member 39 which secures the topmost partition 25 tightly against the top edges of uppermost divider 23.

In accordance with one of the features of the invention, the particular heights of dividers 19, 21 and 23 are such so that dividers 21 and 23 when combined together with an intervening partition 25, has a height generally equal to the height of large divider 19. Likewise, the height of smaller divider 23 is slightly less than ⅓ the height of divider 19 so that three of the smaller dividers 23 can be used in place of a single divider 19 together with intervening partitions 25 and substantially fill chamber 7 of outer housing 3. Likewise, a pair of large dividers 19 can be used with an intervening partition 25 to substantially fill interior storage chamber 7 of housing 3. Other combinations of the dividers can be used, all of which will enable the dividers to nearly fill internal storage chamber 7 when combined with the thickness of one or more partitions 25 providing for a compact and stable arrangement of the dividers and intervening partitions avoiding a large access space between the topmost partition 25 and the closure flaps. The sum of the vertical height of the stacked dividers together with the thickness of the partitions, substantially equal the internal vertical height of storage chamber 7. As an example, divider 19 may have a height of approximately 6 inches, divider 21 may have a height of approximately 4 inches, and divider 23 may have a height of approximately 1½ inches.

Figure 4:
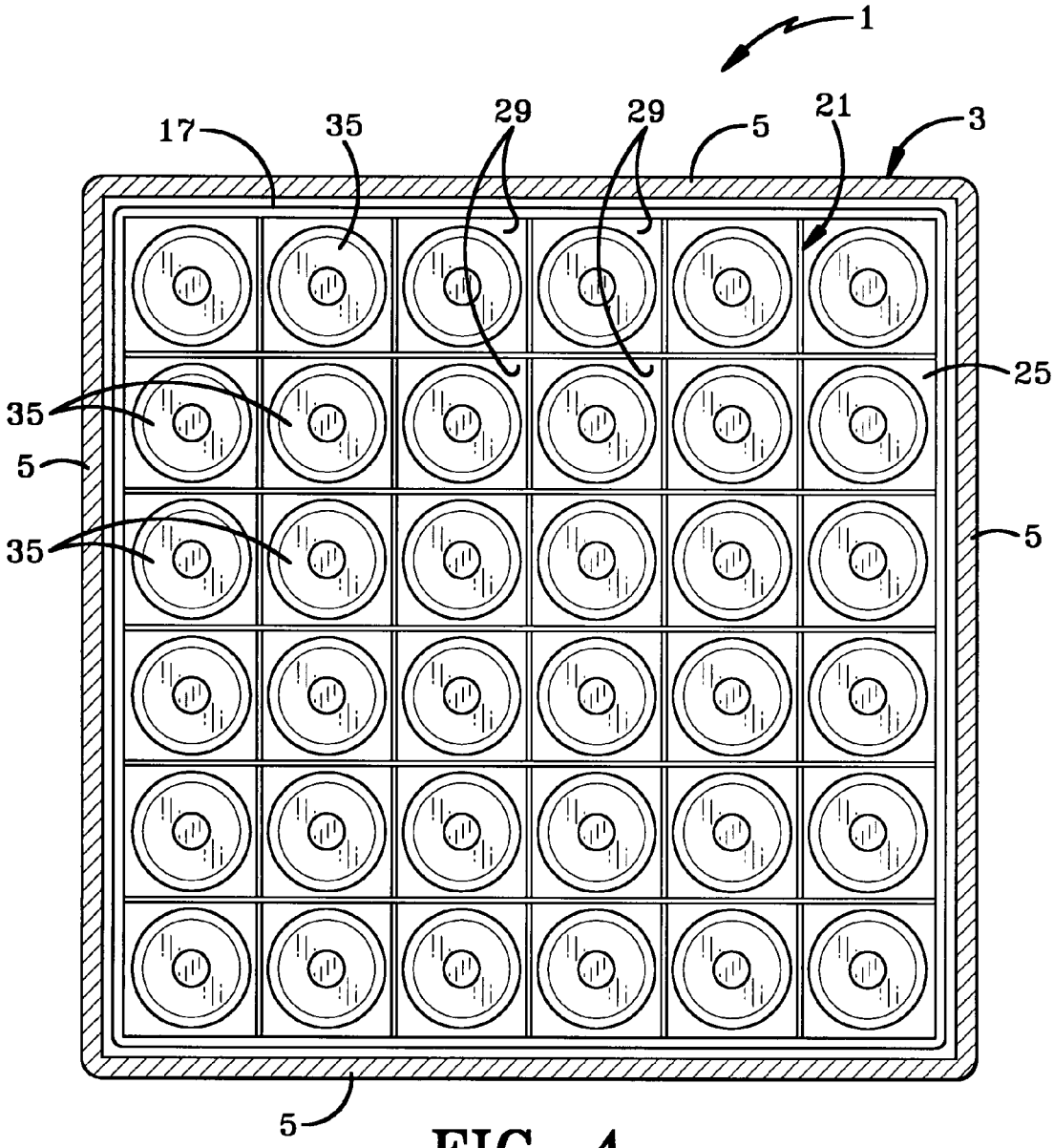
FIG. 4 is a sectional view taken on line 4-4, FIG. 3.

As can be seen in FIG. 4, each of the batteries will be located within a separate compartment and completely isolated from horizontally adjacent batteries as well as vertically adjacent batteries by the intervening walls of the dividers and partitions 25. Plastic liner 17 prevents exterior moisture from affecting the batteries stored in the housing as well as retaining any leakage acid from the batteries from seeping through outer housing walls 5. Liner 17 also prevents any of the stored batteries from being exposed to walls 5 if dislodged from their individual storage compartments.

In summary, the improved shipping container of the present invention provides a container having a substantially rigid outer housing formed of a corrugated fiberboard material with an interior plastic liner which will contain a plurality of different size dividers, which when stacked in a vertical tiered relationship and separated by partitions, form a plurality of individual storage compartments of various sizes, depending upon the particular divider or dividers placed within the storage container, for individually holding various size batteries for shipment, which batteries are prevented from contacting adjacent batteries even should the shipping container be moved to various positions, even in an upside down position.

It is understood that housing 3 can have other configurations than that shown in the drawings and discussed above without affecting the concept of the invention, with the configurations of the partitions and dividers being complementary to the housing and plastic liner.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. In combination, a plurality of batteries and a container for the storage and shipment of a plurality of said batteries; said combination comprising:

an outer housing having an open top providing an internal storage chamber, said housing having spaced side walls, a bottom wall and at least one closure flap extending from at least one of the side walls for closing the open top of the storage chamber;

a flexible liner formed of a plastic material placed in and conforming generally to the shape and size of the internal storage chamber;

a plurality of dividers arranged in a vertical stacked relationship within the storage chamber and flexible liner, each divider providing a plurality of individual storage compartments having open tops for placement of a solid item in the individual storage compartments;

a plurality of planar partition members located between adjacent pairs of the dividers; and individual batteries of said plurality of batteries being located each in a separate storage compartment of the dividers.

2. The combination defined in claim 1 wherein the housing is formed of fiberboard and has a parallelepiped shape with two pairs of spaced parallel sidewalls.

3. The combination defined in claim 2 wherein the fiberboard is of a double-wall corrugated fiberboard material.

4. The combination defined in claim 1 wherein the flexible liner is formed of polyethylene.

5. The combination defined in claim 4 wherein the polyethylene liner has a thickness of approximately 3 mils.

6. The combination defined in claim 1 wherein the individual storage compartments in at least one of the dividers are substantially equal in size to each other and differ in size from the individual storage compartments of certain of the other of said dividers.

7. The combination defined in claim 6 wherein three dividers are located in the storage chamber, each divider having different size storage compartments from the storage compartments of the other two dividers; and in which three partitions are located in the storage chamber, one partition between each adjacent pair of dividers and one partition between the topmost divider and closure flaps.

8. The combination defined in claim 6 wherein one of the dividers has a height of approximately 6 inches, a second of said dividers has a height of approximately 4 inches, and a third of said dividers has a height of approximately 1-½ inches.

9. The combination defined in claim 1 wherein each of the partition members has a thickness of approximately ¼ inch.

10. The combination defined in claim 1 wherein the side walls of the housing have a thickness of approximately ¼ inch.

11. The combination defined in claim 1 wherein the housing has a parallelepiped shape and includes four of the closure flaps, each of which extends from a respective one of the side walls; and wherein each of said flaps terminates in an outer edge.

12. The combination defined in claim 11 wherein the outer edges of pairs of opposed flaps are in abutting relationship with each other; and wherein one of the pairs of opposed flaps overlies the other pair of opposed flaps when the flaps are in a closed position closing the open top of the storage container.

13. The combination defined in claim 12 including a first strip of a sealing tape extending over and along the abutting outer edges of the said pair of overlying flaps; and wherein second and third strips of a sealing tape extend along opposed junctions of the overlapping flaps with their respective side walls providing an H-shaped sealing tape arrangement when closing the open top of the storage chamber.

14. The combination defined in claim 1 wherein certain of the dividers have different vertical heights and different number of individual storage compartments than other of said dividers.

15. The combination defined in claim 14 wherein the sum of the vertical heights of the dividers is substantially equal to the vertical height of the storage chamber.

16. The combination defined in claim 1 wherein the outer housing is formed of a double-wall corrugated fiberboard material and the liner of polyethylene.

17. The combination defined in claim 1 wherein the housing includes four of the closure flaps, each of which extends from a respective one of the side walls and terminates in an outer edge; and wherein three strips of sealing tape seal the flaps in a closed sealed position, one strip extends along abutting outer edges of a pair of top closure flaps and the other two strips extend along opposed junctions of the top closure flaps and their respective side walls forming an H-shaped sealing tape arrangement.

18. A method for the storage and shipment of a plurality of batteries in a shipping container comprising the steps of:

providing a housing having an open top forming an internal storage chamber, said housing having side walls, a bottom wall and a top closure for closing the open top of the storage chamber;

placing a flexible liner formed of a plastic material placed in the internal storage chamber;

placing a first divider within the storage chamber and flexible liner, said first divider providing a plurality of individual storage compartments having open tops;

placing a plurality of individual batteries in each of the separate individual storage compartments in said first divider;

placing a partition member on top of said first divider after placement of the batteries in the storage compartment;

repeating the steps of placing a divider with an intervening partition member in the storage container and filling each of the compartments with a battery until the vertical height of the stacked dividers and partition member substantially equals the vertical height of the storage chamber;

closing an open top of the flexible liner after placement of the batteries in the storage compartments of the stacked dividers; and closing the open top of the storage container with the top closure; and sealing the top closure.

19. The method defined in claim 18 including the steps of providing the dividers with varying vertical heights and different size storage compartments to accommodate different size batteries.

* * * * *